United States Patent [19]

Zbornik

[11] Patent Number: 4,509,357

[45] Date of Patent: Apr. 9, 1985

[54] TOOL ARRANGEMENT FOR A BENDING PRESS

[75] Inventor: Vaclav Zbornik, Oftringen, Switzerland

[73] Assignee: Hämmerle AG Maschinenfabrik, Zofingen, Switzerland

[21] Appl. No.: 497,144

[22] Filed: May 23, 1983

[30] Foreign Application Priority Data

Jun. 7, 1982 [CH] Switzerland ..... 3496/82

[51] Int. Cl.[3] ..... B21D 17/02

[52] U.S. Cl. ..... 72/384; 72/389; 72/442; 72/477

[58] Field of Search ..... 72/384, 389, 413, 481, 72/482, 390, 441, 442, 477, 414, 406, 319, 320

[56] References Cited

U.S. PATENT DOCUMENTS

| | | | |
|---|---|---|---|
| 3,509,757 | 5/1970 | Hänni | 72/414 |
| 3,681,994 | 8/1972 | Zbornik | 72/389 |
| 3,845,655 | 11/1974 | Krieg | 72/389 |
| 4,014,204 | 3/1977 | Hänni et al. | 72/413 |
| 4,016,742 | 4/1977 | Shiokawa | 72/389 |
| 4,063,445 | 12/1977 | Haenni et al. | 72/389 |
| 4,366,699 | 1/1983 | Tsuchiyama | 72/389 |

FOREIGN PATENT DOCUMENTS

| | | | |
|---|---|---|---|
| 2034518 | 1/1972 | Fed. Rep. of Germany | 72/384 |
| 2018647 | 10/1979 | United Kingdom | 72/389 |
| 2032308 | 5/1980 | United Kingdom | 72/319 |

*Primary Examiner*—Daniel C. Crane
*Assistant Examiner*—David B. Jones
*Attorney, Agent, or Firm*—Werner W. Kleeman

[57] ABSTRACT

Bending presses equipped with the tool arrangement permit sheet blanks or metal plating to be bent in series in accordance with predetermined programs without having to perform time consuming tool exchange operations after each single operative or working step. The tool arrangement comprises a first tool and a second two-piece auxiliary tool. Both parts of the auxiliary second tool are subdivided into segments as is the case also for the first tool and the tool holding fixture or support and are supported at a hydraulic cushion. The segmental matching design of the tool holding fixture, the first tool, the auxiliary second tool and the bottom dies additionally enables the two types of tools and their associated bottom dies to be simultaneously controllably directed into a respective operative position over part of the length of the bending press. Thus, in certain cases at least two pieces of sheet metal, the width of which, when arranged in juxtaposition, is less than the total width of the bending press, can be simultaneously and differently bent using the same working stroke. It is also possible to work at two or more stations in series.

13 Claims, 3 Drawing Figures

TOOL ARRANGEMENT FOR A BENDING PRESS

BACKGROUND OF THE INVENTION

The present invention relates to a new and improved tool arrangement or apparatus for a bending press.

In its more particular aspects, the tool arrangement of the present development is intended for use with a bending press equipped with a displaceable ram, an elastically yielding hydraulic cushion within the ram and a work table. A segmental tool holding fixture is mounted in the hydraulic cushion and a tool support is secured to the work table. This tool support comprises a bottom die with which cooperates a segmental first tool arranged in the tool holding fixture.

It has been suggested for a bending press as known, for example, from German Pat. No. 2,522,882, to form the tool which is elastically yieldably supported at an oil cushion from a number of partial elements which are arranged in juxtaposition and which are vertically displaceable independently of each other. Only those partial elements which indirectly or directly engage the workpiece are displaced towards the oil cushion under load.

The proposed design of the bending press ensures for a uniform distribution of pressure at the ram tip throughout the entire bending length of the workpiece, whereby high precision in the working operation and faultless bending results are obtained.

It happens rather frequently that bending operations have to be performed in accordance with a predetermined program according to which an operative or work step, but with the use of a further, different tool, is required to be performed between the individual operating or working steps where there is used the tool present in the tool arrangement. For this purpose the tool inserts have to be exchanged against others. The suggested bending press is thus unsuitable for such use, since the exchange operations are cumbersome and time-consuming and, above all, disadvantageously affect series or mass production manufacturing operations.

In another bending work installation as known, for example, from German Patent Publication No. 2,652,886, an auxiliary tool is associated with a main or primary tool. By means of positioning or control cylinders that one of the tools can be selectively placed into operation which is required for performing a predetermined bending operation. An upper portion of the two-piece auxiliary tool is fixedly connected to the main tool while a lower portion of the auxiliary tool is positively or form-lockingly and vertically displaceably mounted in a guiding member or bracket. The two portions of the auxiliary tool are designed in a mirror-image relationship, for example, in a saw-tooth shape or meander-like configuration. In their rest or idle position they are matchingly interengaged. The auxiliary tool is brought into the work or operative position by downwardly and laterally displacing the lower tool portion in the same plane by means of the positioning or control cylinders and the guiding members such that for the transmission of the ram force the interrupted lower surfaces of the upper fixed tool portion and the interrupted upper surfaces of the lower displaceable tool portion are positioned on top of each other.

It is a disadvantage of this known installation as described hereinbefore that, in addition to the involved and expensive design of the two parts or members of the auxiliary tool, either the main tool or the two-piece auxiliary tool only can be placed into an operative or into an idle or rest position over the entire width of the multiple tool. It is required, for example, for the U-shaped bending of sheet metal pieces bent at all sides, to substitute the multiple tool of a given length with a multiple tool of a different length.

SUMMARY OF THE INVENTION

Therefore, with the foregoing in mind it is a primary object of the present invention to provide a new and improved tool arrangement which is suitable for simultaneously performing different bending operations at least at two sheet metal workpieces during one common operative or working stroke of the bending press.

Another important object of the present invention aims at providing a new and improved tool arrangement for a bending press which enables reliably and accurately performing complicated bending operations, such as the U-shaped bending of sheet metal pieces bent on all sides in accordance with a predetermined program.

Still a further significant object of the present invention is directed to a new and improved tool arrangement for a bending press in which complicated bending operations can be performed in accordance with a predetermined program without the entire first tool and/or the entire auxiliary second tool having to be exchanged after individual operating or working steps.

Now in order to implement these and still further objects of the invention, which will become more readily apparent as the description proceeds, the tool arrangement of the present development is manifested by the features that, a two-piece or two-part auxiliary second tool is provided in addition to the segmental first tool within the tool holding fixture. This two-piece auxiliary second tool is subdivided into horizontally displaceable spacer segments and into vertically displaceable tool segments and is selectively displaceable into an operative or work position in which the spacer segments and the tool segments are positioned on top of each other and into an inoperative position in which the spacer segments and the tool segments are juxtaposed or arranged neighboring or along side of one another. The horizontally displaceable spacer segments are structured for displacement normally or perpendicular to the displacement plane of the vertically displaceable tool segments, and these vertically displaceable tool segments are structured for displacement substantially parallel to the displacement plane of the segmental first tool.

The advantages achieved by the tool arrangement according to the invention are essentially that the segmental design of the programmable tool arrangement permits the provision of the most advantageous total width of the first tool and of the second tool for a predetermined program by providing a greater or smaller number of active segments. This segmental design of the programmable tool arrangement also enables, in the case of U-shaped bending of sheet metal pieces bent on all sides, appropriately controlling the necessary active width required therefor at the main or auxiliary tool without the two tools of the tool arrangement having to be totally exchanged. Above all, the individually controllable segments of the two tools and the associated bottom dies permit at least two sheet metal workpieces to be differently and simultaneously bent with the same operating stroke during series manufacturing or mass production.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
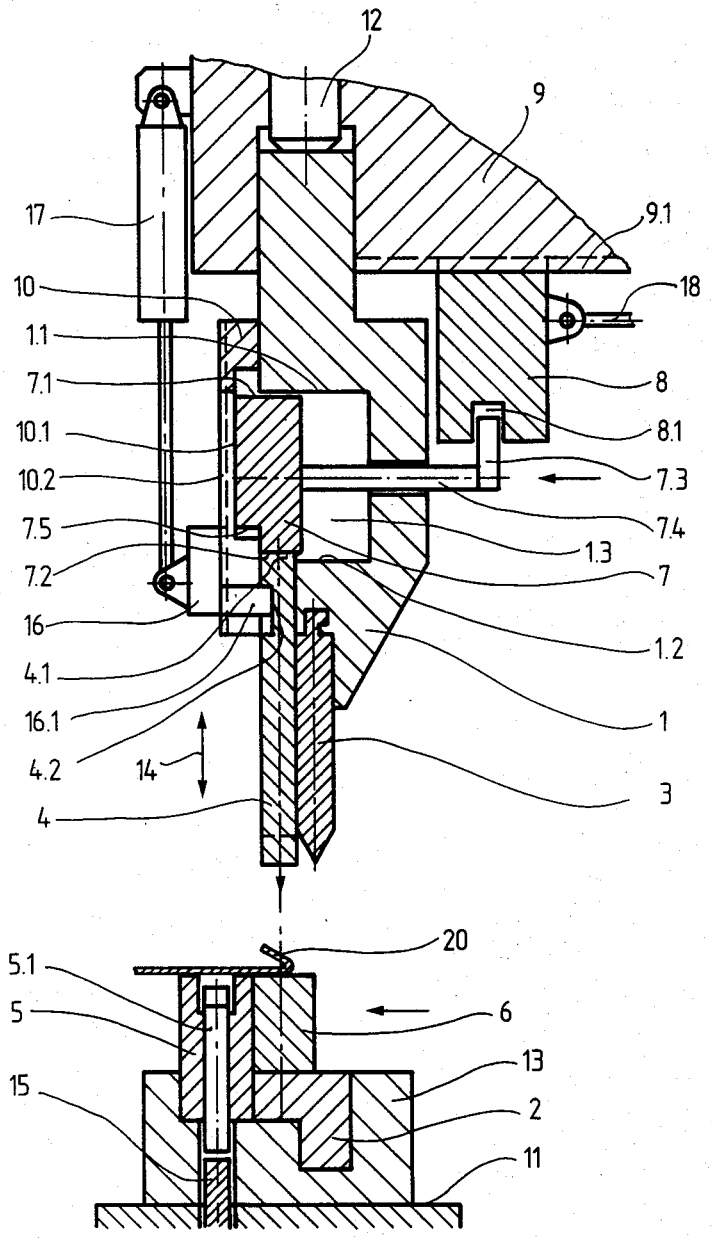
FIG. 1 is a section through the tool arrangement according to the invention, the first tool being shown in its inoperative or rest position and the auxiliary second tool being shown in its operative position.
Figure 2:
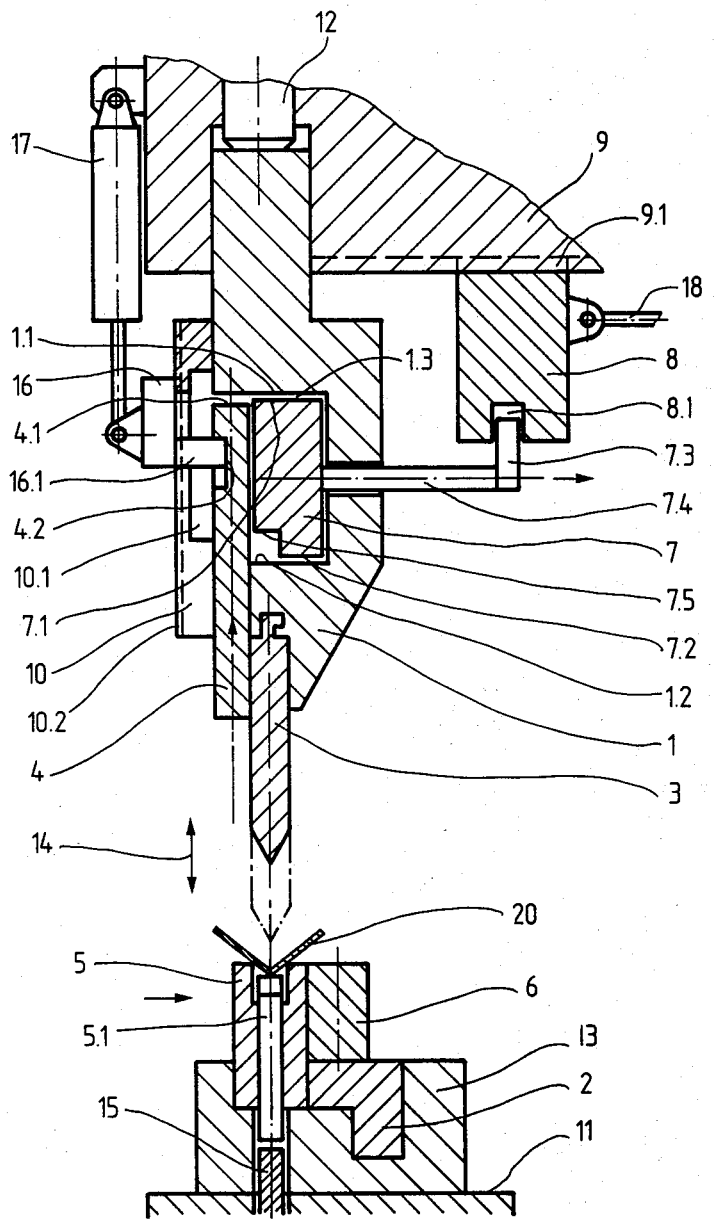
FIG. 2 is a section through the tool arrangement shown in FIG. 1, with the first tool being shown in its operative position and the auxiliary second tool being shown in its inoperative position.
Figure 3:
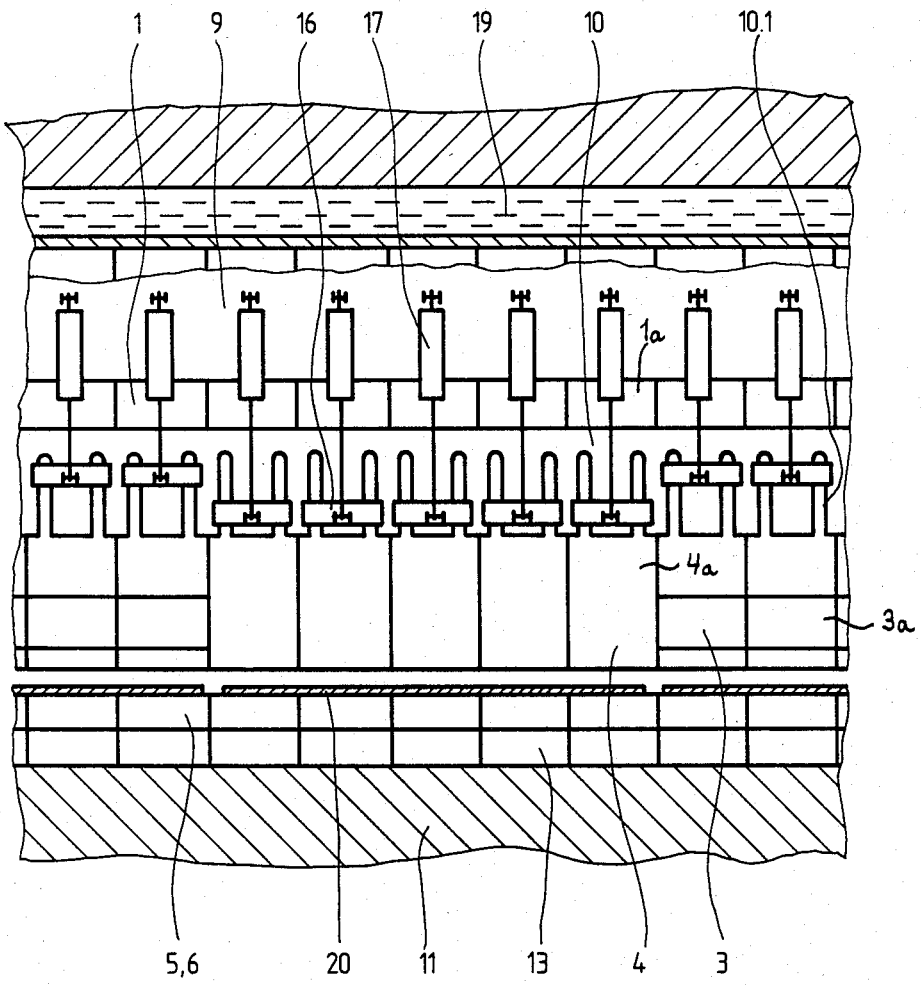
FIG. 3 is a schematic longitudinal section through the working or work table of a bending press including the tool arrangement according to the invention with segments of the first tool and of the accessory second tool being readjusted.

Describing now the drawings, it is to be understood that only enough of the construction of the tool arrangement or apparatus has been shown as needed for those skilled in the art to readily understand the underlying principles and concepts of the present development, while simplifying the showing of the drawings. In FIGS. 1, 2 and 3 identical parts have been designated by the same reference numerals.

Turning attention now specifically to the drawings, there has been indicated a segmental tool holding fixture connected to a ram by reference numeral 1 and an upper sliding surface and a lower sliding surface in a recess 1.3 arranged in the tool holding fixture 1 by reference numerals 1.1 and 1.2, respectively, as best seen by referring to FIG. 2. The segments 1*a* of the tool holding fixture 1 are slidably guided in a hydraulic cushion body 9 and supported at support elements 12 of a hydraulic cushion or hydrocushion 19. The segments 1*a* of the tool holding fixture serve to support the individual segments 3*a* of a segmental first tool 3 and the segments 4*a* of an auxiliary second tool. The auxiliary second tool comprises horizontally displaceable spacer or distance segments 7 and vertically displaceable tool segments 4. The vertically displaceable tool segments 4 each possess a holding or retaining recess 4.2 engaged by two projections or nose members 16.1 of a respective sliding block 16. For this purpose and as shown in FIGS. 1 and 3, substantially vertically arranged slots 10.1 are provided in a cover plate 10 and the projections or nose members 16.1 of the sliding blocks 16 protrude through these slots 10.1.

The sliding blocks 16 are slidably guided in vertical guide or guiding grooves 10.2 which may be designed, for example, like dovetail grooves. Control or positioning cylinders 17 serve to either pull the sliding or slide blocks 16 vertically upwardly into an inoperative position or to vertically downwardly push the same into an operative or work position. These control or positioning cylinders 17 are suspended from the hydraulic cushion body 9. The horizontally displaceable spacer segments 7 of the auxiliary second tool are embedded in the recess or cavity 1.3 of the tool holding fixture 1 and each have an upper bearing or contact surface 7.1, two lower bearing or contact surfaces 7.2 and 7.5 and at least one guiding or guide pin 7.4 including a tab or nose member 7.3.

Sliders 8 are slidingly guided in horizontally arranged guiding or guide grooves 9.1 formed at the hydraulic cushion body 9. A linkage or rod 18 connects the sliders 8 to any suitable control or positioning cylinders (not shown). The tabs or nose members 7.3 of the individual horizontally displaceable spacer segments 7 of the auxiliary second tool engage related grooves 8.1 formed in the sliders or slide members 8. The horizontally displaceable spacer segments 7 are reciprocated between two or more positions within the recess 1.3 by means of the sliders 8. It will be seen that vertical clearances or play is formed between the grooves 8.1 and the nose members 7.3 and thus between the sliders 8 and the guide or guiding pins 7.4, and such vertical clearances or play is greater than the maximum stroke of the hydraulic cushion body 9. Moreover, the height or vertical length of each of the holding or retaining recesses 4.2 is greater than the sum of the height or vertical length of the projections or nose members 16.1 and the maximum stroke of the hydraulic cushion body 9. The pitch or lateral spacing of the horizontally displaceable spacer segments 7 and of the vertically displaceable tool segments 4 of the auxiliary second tool is equal to the pitch or lateral spacing of the tool holding fixture 1 and the segmental first tool 3. The terms pitch and lateral spacing are to be understood to mean a spacing in the width of the bending press as seen in frontal elevation, for instance in the longitudinal section of FIG. 3.

The tool arrangement as described hereinbefore operates as follows:

To place the segmental first tool 3 into its operative or work position the bottom die 5 is first displaced into a position below this segmental first tool 3. At the same time the horizontally displaceable spacer segments 7 of the auxiliary second tool 4, 7 are retracted into the inoperative or rest position from their operative or work position as shown in FIG. 1 by means of the slider 8 and by means of the tabs or nose members 7.3 engaging the grooves 8.1. Subsequently, the vertically displaceable tool segments 4 of the auxiliary second tool 4, 7 are upwardly pulled or retracted into an inoperative position by using the associated control or positioning cylinders 17 while the projections 16.1 of the sliding blocks 16 engage the holding recess or groove 4.2. These positions correspond to the operative or work position of the segmental first tool 3 as shown in FIG. 2. The segments 3*a* of the segmental first tool 3 are releasably connected to associated segments 1*a* of the tool holding fixture 1 of the ram and are supported at the hydraulic cushion 19 shown in FIG. 3 by means of the support elements 12.

In the embodiment shown in FIG. 2, the segments 3*a* of the segmental first tool 3 are designed as pointed plungers or punches. The bottom die 5 cooperating with the segmental first tool 3 is equipped with vertically displaceable pins 5.1 and with an adjusting ledge or ledge member 15 for controlling the depth of the bottom die 5 during a three-point bending operation. The adjusted depth of the bottom die 5 is determinative for the degree of the bending angle. When the segmental first tool 3 is downwardly displaced in the direction of the arrow 14 the sheet material 20 or the like, still unbent and supported at the bottom die 5, is bent in a first bending operation in which only those segments of the segmental first tool 3 are effective which bear upon the sheet material 20. Further operational or working steps may follow this first operational or working step using either the same segmental first tool 3 or another tool for performing a specific bending operation. In the latter case the two-piece or two-part auxiliary second tool 4, 7 of the tool arrangement according to the invention will be utilised.

To transfer the auxiliary second tool 4, 7 from the inoperative or rest position as shown in FIG. 2 into the operative or work position as shown in FIG. 1, the vertically displaceable tool segments 4 of the auxiliary second tool 4, 7 are vertically downwardly displaced by means of the control or positioning cylinders 17 in the direction of the arrow 14 and parallel to the plane of displacement of the segmental first tool 3 between the segmental first tool 3 and the cover plate 10 provided with the vertical slots 10.1 and the guiding or guide grooves 10.2. When the lowermost position is reached the horizontally displaceable spacer segments 7 are horizontally displaced by means of the tabs or nose members 7.3 engaging the grooves or slots 8.1 in the sliders 8 into the now free space which previously were occupied by the vertically displaceable tool segments 4 of the auxiliary second tool 4, 7 in the inoperative position thereof. Simultaneous with the horizontal displacement of the spacer segments 7 the tool support 2 at the working or work table is displaced in the same direction until the bottom die 6 associated with the auxiliary second tool 4, 7 is precisely placed vertically thereunder. The segmental first tool 3 and the bottom die 5 associated therewith are out of operation in this position, while the auxiliary second tool 4, 7 placed in the operative position and the associated bottom die 6 are ready to be used for bending operations. During such operation the ram pressure is transmitted via the support elements 12 which are supported at the hydraulic cushion 19 to the segments 1*a* of the tool holding fixture 1 and via the sliding or slide surfaces 1.1 thereof and via the bearing or contact surfaces 7.1 and 7.2 of the horizontally displaceable spacer segments 7 to the bearing or contact surfaces 4.1 of the vertically displaceable tool segments 4 of the auxiliary second tool 4, 7 and thus to the sheet material 20 or other workpiece which is to be bent.

Instead of undertaking the rearrangement from the operative position of the segmental first tool 3 into the operative position of the auxiliary second tool 4, 7 over the entire width of the bending press, the rearrangement also may be performed only partially in the tool arrangement constructed according to the invention. Accordingly, over one part of the width of the bending press the segmental first tools 3 and, for example, over the remaining part of the width of the bending press the auxiliary second tools 4, 7 are placed in their respective operative or work positions. Thus, in certain cases, at least at two pieces of sheet material or workpieces 20 which are placed in juxtaposition and have a width which is smaller than the total width of the bending press, two different bending operations can be performed with the same operating or work stroke or at least two such pieces of sheet material 20 can be consecutively operated upon or processed at two or more stations. Thus, for example, FIG. 3 shows at the right-hand side thereof a number of segments 3*a* of the segmental first tool 3 in the operative position in association with a large depth of the bottom die 5 in order to form an acute bending angle, in the central portion five segments 4 of the auxiliary second tool 4, 7 in the operative position, for example, for shallow bending, and on the left-hand side thereof a number of segments 3*a* of the segmental first tool 3 in the operative position associated with a low depth of the bottom die 5 in order to produce a rather small bending angle.

The horizontally displaceable spacer segments 7 of the auxiliary second tool 4, 7 contain a second lower bearing or contact surface which is offset towards the rear. It is thus possible to associate the vertically displaceable tool segments 4 with a second operative or work position in such a manner that the two tools can be jointly employed to produce a double bend. It is readily conceivable that the horizontally displaceable spacer segments 7 may have a number of such second bearing or contact faces associated with various operative positions.

Instead of operatively associating each vertically displaceable tool segment 4 with a respective sliding block 16 and an individual control or positioning cylinder 17 suspended from the hydraulic cushion body 9, it would be possible to combine a number of tool segments 4 into groups by means of a continuous ledge which serves to interconnect the associated sliding blocks 16. Depending upon the number of interconnected tool segments 4 one or two control or positioning cylinders only would be required for the common control of each such ledge or connecting member. In the same manner the individually controlled horizontally displaceable spacer segments 7 could be replaced by spacer segments which are combined in groups and jointly controlled.

In the exemplary embodiment shown in FIGS. 1 and 2, the auxiliary second tool is designed as a flat plunger or punch associated with a flat bottom die contact or bearing surface; instead, a different design of the auxiliary second tool and associated bottom die can be provided.

It is readily conceivable that in a bending press different types of bending operations using different tools can be performed with the same operating or work stroke without the bottom dies having to be subdivided into segments for this purpose. However, it is required for certain arrangements to simultaneously also rearrange the associated part of the corresponding bottom die when one of the tools at the upper member is partially rearranged. For such purpose the bottom die has to be subdivided into the same sub-segments as the tool.

While there are shown and described present preferred embodiments of the invention, it is to be distinctly understood that the invention is not limited thereto, but may be otherwise variously embodied and practiced within the scope of the following claims. Accordingly,

What I claim is:

1. In a tool arrangement for a bending press including a displaceable ram, an elastically yielding hydraulic cushion provided within said ram and a work table, the improvement which comprises:

a segmental tool holding fixture operatively connected with said hydraulic cushion;

a segmental first tool arranged in said segmental tool holding fixture and displaceable in a first displacement plane;

a two-piece auxiliary second tool arranged in said tool holding fixture in addition to said segmental first tool;

said auxiliary second tool being subdivided into substantially horizontally displaceable spacer segments each having a contact surface and related tool segments substantially vertically displaceable in a second displacement plane;

said auxiliary second tool being displaceable into an operative position in which said spacer segments and said tool segments are arranged in substantially superimposed relationship with the contact surface on each spacer segment being in contact with its related tool segments and into an inoperative position in which said spacer segments and said tool segments are arranged in juxtaposition with said contact surfaces in noncontact relationship with said tool segments;

said horizontally displaceable spacer segments being structured for displacement substantially perpendicular to said second displacement plane of said vertically displaceable tool segments and said vertically displaceable tool segments being structured for displacement substantially parallel to said first displacement plane;

a tool support secured to said work table and provided with a bottom die; and said segmental first tool cooperating with said bottom die.

2. The tool arrangement as defined in claim 1, wherein:

said bottom die has at least two operative positions; and said bottom die being selectively horizontally displaceable into a first operative position operatively associated with said operative position of said segmental first tool or into a second operative position operatively associated with said operative position of said auxiliary second tool.

3. The tool arrangement as defined in claim 2, wherein:

said bottom die is subdivided into segments.

4. The tool arrangement as defined in claim 1, wherein:

said hydraulic cushion comprises an hydraulic cushion body;

sliders slidably guided at said hydraulic cushion body and each operatively associated with a respective one of said horizontally displaceable spacer segments of said auxiliary second tool; and control cylinders each acting upon a respective one of said sliders in order to reciprocate said respective spacer segments between two or more positions.

5. The tool arrangement as defined in claim 1, wherein:

said hydraulic cushion comprises an hydraulic cushion body;

groups of said horizontally displaceable spacer segments comprising the same number of or different numbers of said spacer segments;

sliders slidably guided at said hydraulic cushion body and each operatively associated with a respective one of said groups; and at least one control cylinder acting upon a respective one of said sliders to reciprocate the same.

6. The tool arrangement as defined in claim 1, wherein:

each said vertically displaceable tool segment of said auxiliary second tool having an upper end;

a holding recess formed in said upper end;

a sliding block including at least one projection protruding into said holding recess; and a control cylinder acting upon said sliding block.

7. The tool arrangement as defined in claim 6, wherein:

said control cylinder is essentially stationarily mounted.

8. The tool arrangement as defined in claim 1, further including:

a vertically displaceable die bottom provided for at least said bottom die cooperating with said segmental first tool.

9. The tool arrangement as defined in claim 1, further including:

a first pitch respectively associated with said horizontally displaceable spacer segments and said vertically displaceable tool segments of said auxiliary second tool;

a second pitch respectively associated with said tool holding fixture and said segmental first tool; and said first pitch being equal to said second pitch.

10. In a tool arrangement for a bending press including a displaceable ram, an elastically yielding hydraulic cushion provided within said ram and a work table, the improvement which comprises:

a segmental tool holding fixture operatively connected with said hydraulic cushion;

a segmental first tool arranged in said segmental tool holding fixture and displaceable in a first displacement plane;

a two-piece auxiliary second tool arranged in said tool holding fixture in addition to said segmental first tool;

said auxiliary second tool being subdivided into substantially horizontally displaceable spacer segments and tool segments substantially vertically displaceable in a second displacement plane;

said auxiliary second tool being displaceable into an operative position in which said spacer segments and said tool segments are arranged in substantially superimposed relationship and into an inoperative position in which said spacer segments and said tool segments are arranged in juxtaposition;

said horizontally displaceable spacer segments being structured for displacement substantially perpendicular to said second displacement plane of said vertically displaceable tool segments and said vertically displaceable tool segments being structured for displacement substantially parallel to said first displacement plane;

a tool support secured to said work table and provided with a bottom die;

said segmental first tool cooperating with said bottom die;

said hydraulic cushion comprises an hydraulic cushion body;

sliders slidably guided at said hydraulic cushion body and each operatively associated with a respective one of said horizontally displaceable spacer segments of said auxiliary second tool;

control cylinders each acting upon a respective one of said sliders in order to reciprocate said respective spacer segments between two or more positions;

at least one guiding pin provided at each said horizontally displaceable spacer segment;

a nose member carried by said guiding pin;

a groove formed in said slider;

said nose member engaging said groove in said slider;

vertical clearances formed between said groove and said nose member and between said slider and said guiding pin;

said hydraulic cushion having a maximum stroke; and each said vertical clearance exceeding said maximum stroke.

11. In a tool arrangement for a bending press including a displaceable ram, an elastically yielding hydraulic cushion provided within said ram and a work table, the improvement which comprises:

a segmental tool holding fixture operatively connected with said hydraulic cushion;

a segmental first tool arranged in said segmental tool holding fixture and displaceable in a first displacement plane;

a two-piece auxiliary second tool arranged in said tool holding fixture in addition to said segmental first tool;

said auxiliary second tool being subdivided into substantially horizontally displaceable spacer segments and tool segments substantially vertically displaceable in a second displacement plane;

said auxiliary second tool being displaceable into an operative position in which said spacer segments and said tool segments are arranged in substantially superimposed relationship and into an inoperative position in which said spacer segments and said tool segments are arranged in juxtaposition;

said horizontally displaceable spacer segments being structured for displacement substantially perpendicular to said second displacement plane of said vertically displaceable tool segments and said vertically displaceable tool segments being structured for displacement substantially parallel to said first displacement plane;

a tool support secured to said work table and provided with a bottom die;

said segmental first tool cooperating with said bottom die;

each said vertically displaceable tool segment of said auxiliary second tool having an upper end;

a holding recess formed in said upper end;

a sliding block including at least one projection protruding into said holding recess;

a control cylinder acting upon said sliding block;

a cover plate including substantially vertically arranged guiding grooves and slots;

each said sliding block being slidably guided in at least one respective one of said guiding grooves; and each said projection engaging a respective one of said holding recess in a respective one of said vertically displaceable tool segments of said auxiliary second tool through a respective one of said slots.

12. In a tool arrangement for a bending press including a displaceable ram, an elastically yielding hydraulic cushion provided within said ram and a work table, the improvement which comprises:

a segmental tool holding fixture operatively connected with said hydraulic cushion;

a segmental first tool arranged in said segmental tool holding fixture and displaceable in a first displacement plane;

a two-piece auxiliary second tool arranged in said tool holding fixture in addition to said segmental first tool;

said auxiliary second tool being subdivided into substantially horizontally displaceable spacer segments and tool segments substantially vertically displaceable in a second displacement plane;

said auxiliary second tool being displaceable into an operative position in which said spacer segments and said tool segments are arranged in substantially superimposed relationship and into an inoperative position in which said spacer segments and said tool segments are arranged in juxtaposition;

said horizontally displaceable spacer segments being structured for displacement substantially perpendicular to said second displacement plane of said vertically displaceable tool segments and said vertically displaceable tool segments being structured for displacement substantially parallel to said first displacement plane;

a tool support secured to said work table and provided with a bottom die;

said segmental first tool cooperating with said bottom die;

groups of said vertically displaceable tool segments comprising the same number of or different numbers of said tool segments;

a cover plate provided at said tool holding fixture;

sliding blocks slidably guided at said cover plate and each associated with a respective one of said tool segments;

continuous ledges each associated with a respective one of said groups and interconnecting said sliding blocks of each of said groups; and at least one control cylinder acting upon said ledge in order to displace the same.

13. In a tool arrangement for a bending press including a displaceable ram, an elastically yielding hydraulic cushion provided within said ram and a work table, the improvement which comprises:

a segmental tool holding fixture operatively connected with said hydraulic cushion;

a segmental first tool arranged in said segmental tool holding fixture and displaceable in a first displacement plane;

a two-piece auxiliary second tool arranged in said tool holding fixture in addition to said segmental first tool;

said auxiliary second tool being subdivided into substantially horizontally displaceable spacer segments and tool segments substantially vertically displaceable in a second displacement plane;

said auxiliary second tool being displaceable into an operative position in which said spacer segments and said tool segments are arranged in substantially superimposed relationship and into an inoperative position in which said spacer segments and said tool segments are arranged in juxtaposition;

said horizontally displaceable spacer segments being structured for displacement substantially perpendicular to said second displacement plane of said vertically displaceable tool segments and said vertically displaceable tool segments being structured for displacement substantially parallel to said first displacement plane;

a tool support secured to said work table and provided with a bottom die;

said segmental first tool cooperating with said bottom die;

each said vertically displaceable tool segment of said auxiliary second tool having an upper end;

a holding recess formed in said upper end;

a sliding block including at least one projection protruding into said holding recess;

a control cylinder acting upon said sliding block;

said hydraulic cushion has a maximum stroke; and said holding recess having a vertical length which exceeds the sum of the vertical length of said projection at a respective one of said sliding blocks and said maximum stroke.

* * * * *